US005441101A

United States Patent [19]

Johnsson

[11] Patent Number: 5,441,101

[45] Date of Patent: Aug. 15, 1995

[54] RECYCLING MACHINE

[76] Inventor: John C. S. Johnsson, 1447 Delia Dr., Port Coquitlam B.C., Canada, V3C 2V9

[21] Appl. No.: 1,974

[22] Filed: Jan. 8, 1993

[51] Int. Cl.[6] ..... F28G 13/00

[52] U.S. Cl. ..... 165/95; 134/169 A; 137/545

[58] Field of Search ..... 165/95, 119; 134/169 A; 137/545

[56] References Cited

U.S. PATENT DOCUMENTS

| | | | |
|---|---|---|---|
| 1,549,952 | 8/1925 | Anderson | 134/169 A |
| 2,454,585 | 11/1948 | Alderman | 134/169 A |
| 4,293,031 | 10/1981 | Babish et al. | 165/95 |
| 4,791,890 | 12/1988 | Miles et al. | 165/95 X |
| 4,809,769 | 3/1989 | Vataru | 165/1 |
| 4,899,807 | 2/1990 | Vataru | 165/1 |
| 4,901,786 | 2/1990 | Vataru | 165/1 |
| 5,015,301 | 5/1991 | Baylor | 134/22.1 |
| 5,021,152 | 6/1991 | Filowitz | 165/1 R |
| 5,078,866 | 1/1992 | Filowitz | 210/167 |
| 5,097,806 | 3/1992 | Vataru | 123/198 A |

*Primary Examiner*—Stephen M. Hepperle
*Attorney, Agent, or Firm*—Townsend and Townsend Khourie and Crew

[57] ABSTRACT

An apparatus to change and recondition a coolant of a car having a radiator, an engine block and a top hose connecting the radiator and the engine block. The apparatus having a valve to be received in the top hose. There is an inlet and an outlet pipe to be connected to the valve. A pump is connected to the inlet pipe and to the outlet pipe. There are tanks, each having an inlet and an outlet, to receive coolant from the pump and to supply coolant to the pump. These tanks also act to store reconditioned coolant and to receive coolant to be reconditioned. Valves direct coolant flow to one or other of the tanks as required. Using the apparatus coolant can be withdrawn from the radiator, pumped to a first or second tank, reconditioned in that tank, passed to the other of the two tanks and then returned to the engine block.

23 Claims, 4 Drawing Sheets

RECYCLING MACHINE

FIELD OF THE INVENTION

This invention relates to an apparatus to change and recondition the coolant of a car.

DESCRIPTION OF THE PRIOR ART

The vast majority of cars are liquid cooled. In the vast majority of cases liquid cooled cars are cooled by a mixture of water and ethylene glycol. Such a mixture greatly reduces the freezing point of the coolant, which is desirable in colder climates, but also increases the boiling point of the coolant, making it more useful in hotter temperatures.

In general, manufacturers recommend that the coolant in an engine be changed at most after two years of use. Sludge inevitably develops in an engine and even though anti-corrosion compounds are usually placed in commercial ethylene glycol sold as a car coolant there is corrosion in the engine and radiator. This corrosion, in combination with the sludge, reduces the efficiency of the coolant system by blocking the passageways of the cooling system, particularly in the radiator.

Accordingly it has been traditional to drain the coolant and refill the radiator system using a new 50% aqueous solution of ethylene glycol.

The used coolant is typically run away down a drain. However this is no longer acceptable on a number of grounds. First it is undesirable to introduce ethylene glycol into the environment. It is toxic to animals. Secondly, in addition to concerns about the environment, there are concerns about unnecessary waste. Ethylene glycol coolant can be reclaimed, reconditioned and reused. At the temperatures generated in a liquid cooled car engine there is no chemical decomposition of the glycol. It is rejected simply because it has become contaminated with impurities and particles developed by corrosion of metal parts of the engine.

There have, accordingly, been a number of suggestions for the reclaiming of ethylene glycol solutions. Typically these processes involve the treatment of the coolant with organic compounds able to remove the impurities.

As a further development machines have been developed that can treat the coolant to recondition it to make it ready for further use.

In general, although these machines have achieved quite good acceptance, there are certain undesirable characteristics present in the machines available. For example, a compressed air supply may be required in service machines as a means of pressurizing the system to force the coolant from the system.

SUMMARY OF THE INVENTION

The present invention seeks to provide a simple apparatus to change and recondition the coolant of a car that requires a pump to remove the coolant from the engine and, simultaneously, replenish the coolant system. Using the apparatus of the present invention an engine can be drained and refilled within about two to six minutes.

Accordingly the present invention provides an apparatus to change and recondition a coolant of a car having a radiator, an engine block and a top hose connecting the radiator and the engine block, said apparatus comprising a valve to be received in said top hose; an inlet pipe and an outlet pipe to be connected to said valve; a pump connected to said inlet pipe and said outlet pipe; first and second tanks, each having an inlet and an outlet, to receive coolant from said pump, to supply coolant to said pump, to store reconditioned coolant and to receive coolant to be reconditioned; valves to direct coolant flow; whereby coolant can be withdrawn from the engine block and the radiator, pumped to a first or second tank, reconditioned in that tank, passed to the second or first tank and returned to the engine.

DESCRIPTION OF THE DRAWINGS

The invention is illustrated in the drawings in which.

DESCRIPTION OF THE PREFERRED EMBODIMENTS

Figure 3:
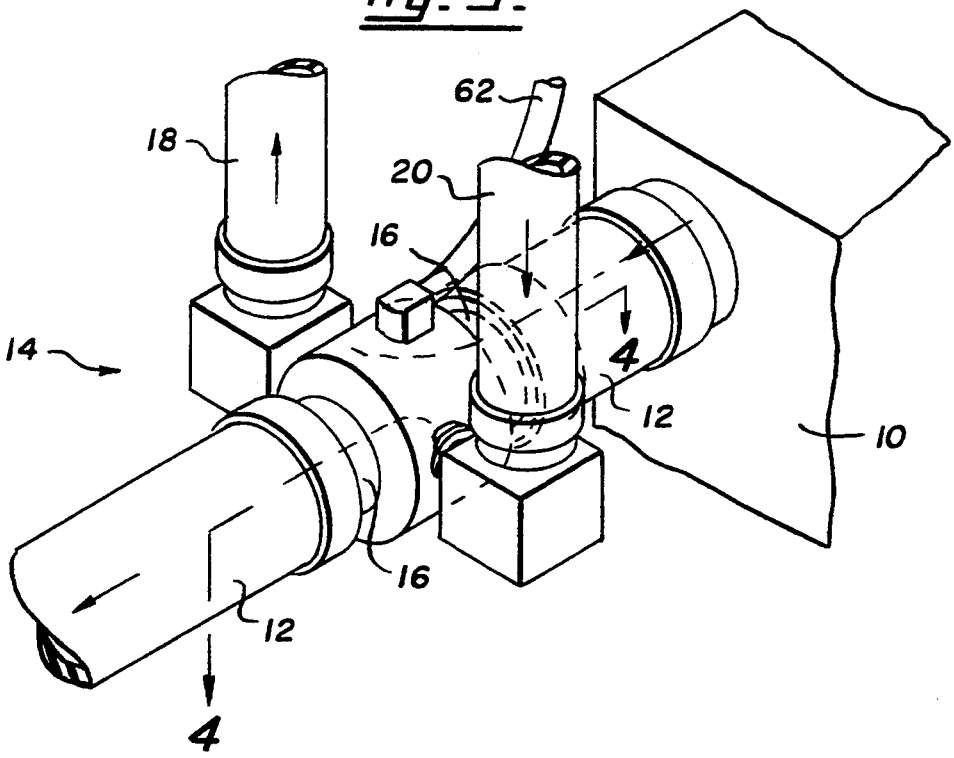
FIG. 3 is a detail of the valve of the apparatus according to the present invention.

The illustrated apparatus of the present invention is useful to change and recondition the coolant of a car having a radiator 10, shown in FIG. 3, an engine block (not shown) and a top hose 12 connecting the radiator 10 and the engine block. This arrangement is common in all automobiles that are liquid cooled, that is to say the vast majority of modern automobiles. The apparatus includes a coupling 14, that is received in the top hose 12. The hose 12 can be made with a breakable joint 16, the parts of which are normally connected together. However when it is necessary to recondition the coolant the joint 16 can be broken and the coupling 14 introduced into the hose 12. These breakable joints are well known in the art.

The apparatus includes an inlet pipe 18 and an outlet pipe 20 to be connected to the coupling 14. There is a pump 22 connected to the inlet pipe 18 and the outlet pipe 20. The pump 22, as illustrated, is a double diaphragm pump. A first side 24 is used to pump a recycled mixture into the cooling system while a second side 26 draws the old coolant out of the cooling system. The apparatus includes a first tank 28 and a second tank 30. There are conduits joining the various parts of the system. The conduits are marked with arrow heads which show the direction of flow in the conduits.

Each of the tanks 28 and 30 has an inlet 32 at its top and an outlet 34 in its bottom. There are valves 36 and 38 to direct coolant flow in such a manner that the coolant can move to and from the pump 22. These valves 36 and 38 direct flow so that one of the tanks 28 or 30 can be used to store reconditioned coolant and the other to receive coolant to be reconditioned. There is a first filter 40 in the inlet pipe 18 before the pump. Typically the filter 40 is able to remove particles having a size greater than about 30 microns. There is a second filter 42 in the outlet pipe 20 after the pump 22. Filter 42 is preferably one capable of removing particles having a size of greater than about 5 microns.

Valve 38 is a three-way suction control valve between the tank inlets 34 so that coolant received from the radiator 10 through the second side 26 of pump 22 can be directed to the first 28 or the second tank 30 as desired. Valve 36 is a three-way pressure directional control valve between the tank outlets 34 and the first side 24 of the pump 22 so that a tank 28 or 30 can be selected to be the source of reconditioned coolant to return to the radiator along pipe 20. There is a third filter 44 between the three-way valve 36 and the first side 24 of the pump 22. Preferably filter 44 is one able to remove particles having a size greater than about 100 microns.

Figure 1:
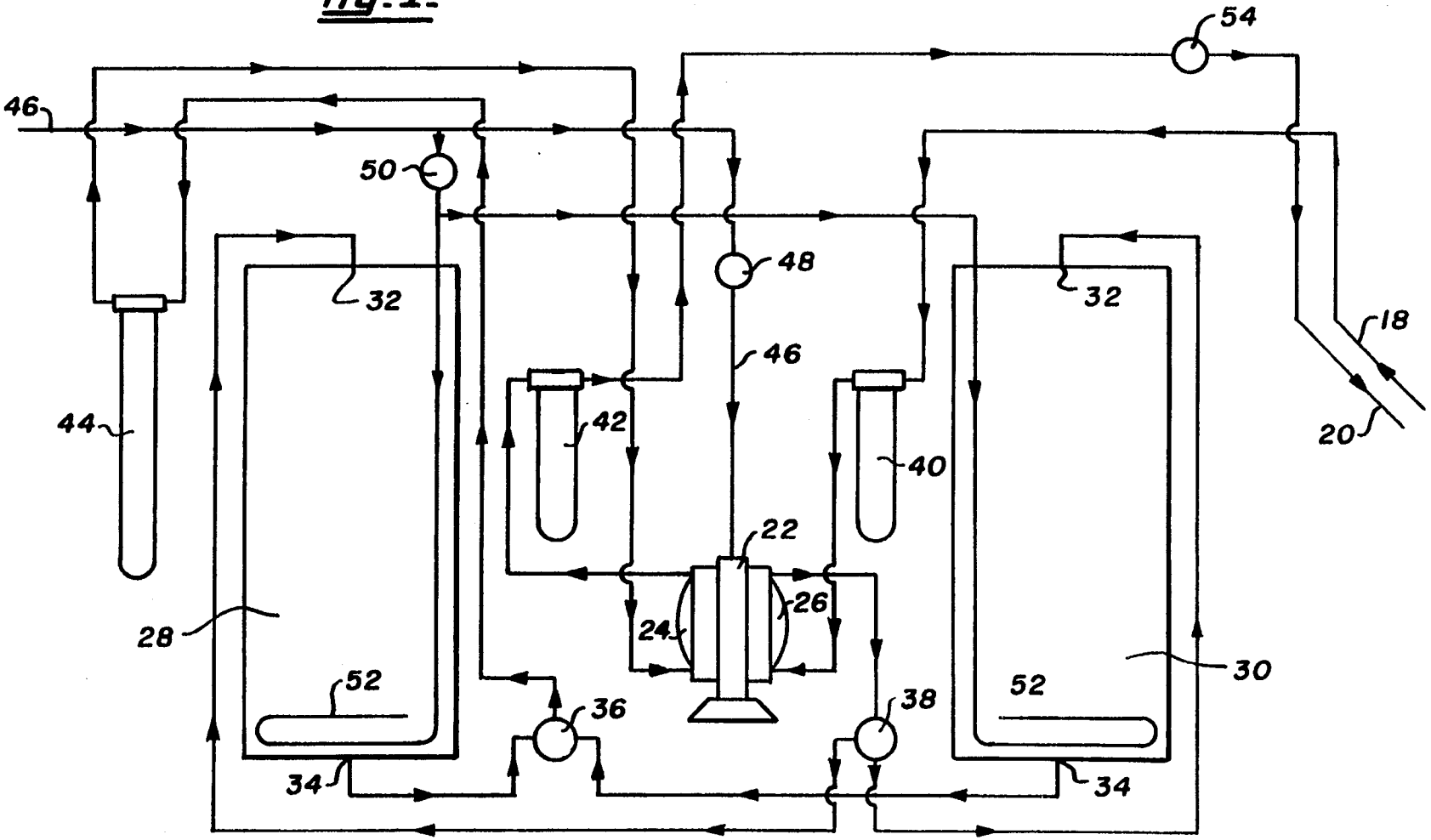
FIG. 1 is a schematic view illustrating the apparatus according to the present invention.

In the embodiment illustrated in FIG. 1 the diaphragm pump 22 is operated by an air supply fed along conduit 46. Conduit 46 includes a control valve 48, typically of screw type.

The air supply that operates the diaphragm pump also feeds through a pressure control valve 50 so that it can operate air sparges 52 in the tanks 28 and 30. These sparges 52 act to agitate the coolant during reconditioning. The tanks 28 and 30 can receive chemicals, well known in the art, that carry out a reconditioning function within the tank.

Outlet pipe 20 includes a pressure regulator 54 to regulate the pressure at which the coolant is returned to the block.

Figure 4:
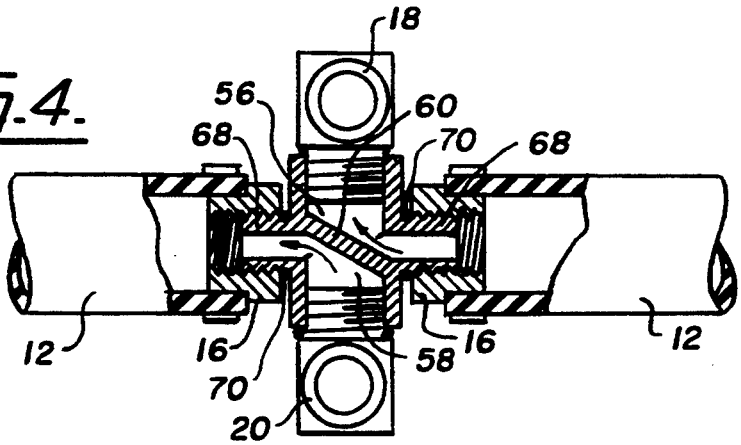
FIG. 4 is a section on the line 3—3 of FIG. 2.

As shown particularly in FIG. 3 and FIG. 4 the coupling 14 may be a single valve with a pair of pathways 56 and 58 divided by an internal wall 60, shown most clearly in FIG. 3, separating the inlet and outlet flow. There is also an air bleed 62 as cooling systems should not contain air.

Figure 6:
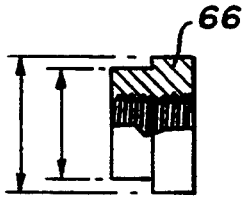
FIG. 6 illustrates a detail of the apparatus of the present invention.

As shown particularly in FIGS. 4 and 6, the coupling 14 may include adaptors 66 to receiving varying sizes of top hose 12. Such an adaptor 66 is shown in FIG. 6. It is internally threaded to be received on threaded spigots 68 on the coupling 14. These adaptors are sealed to the valve body by O-rings 70. They may have knurled exteriors to facilitate grip.

Figure 5:
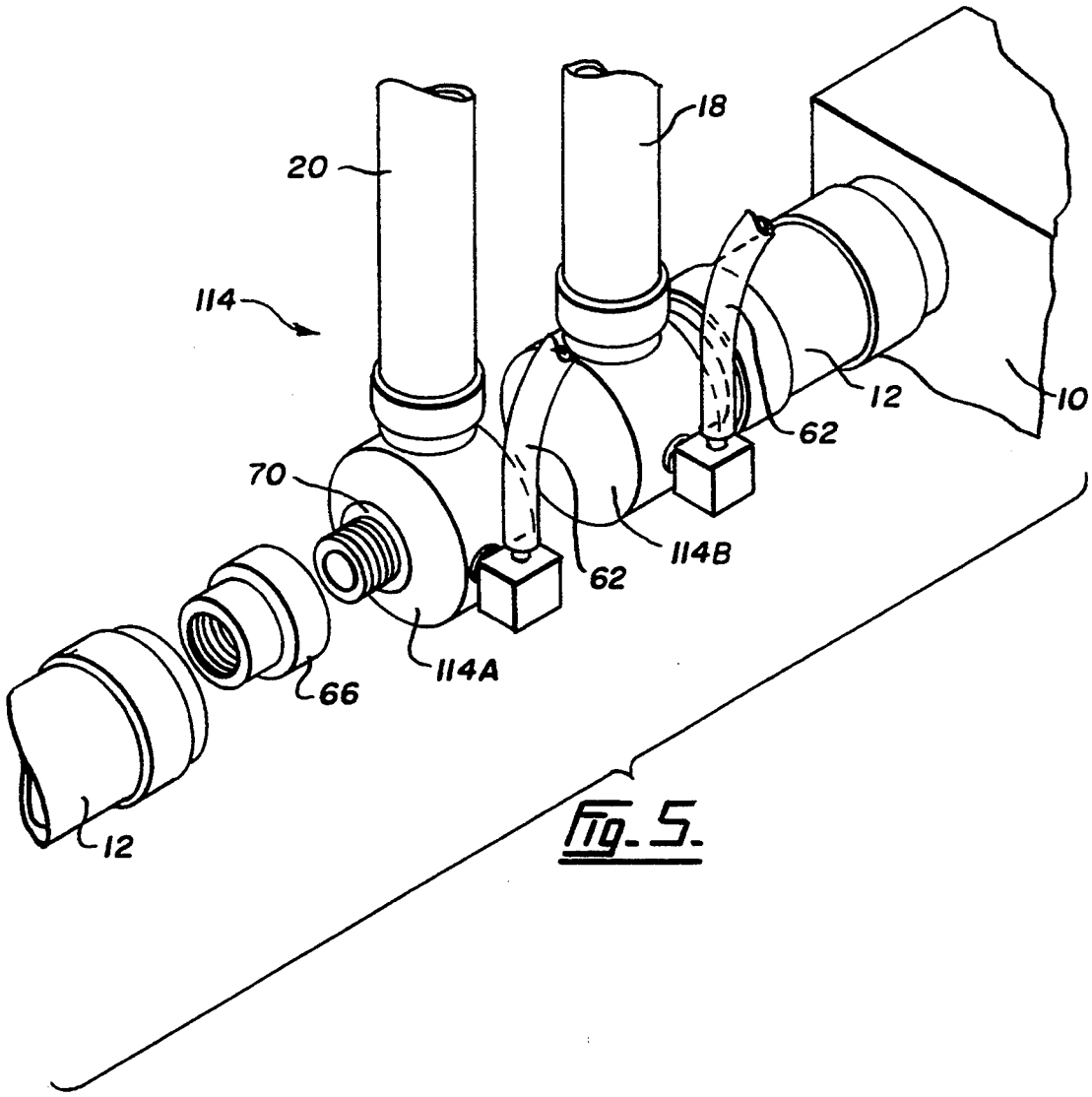
FIG. 5 is a detail of a second valve useful in the apparatus of the present invention.

The coupling shown in FIG. 3 may be replaced by an coupling 114, comprising two members, one for each part of the top hose 12, and also communicating with the inlet 18 and outlet pipes 20. FIG. 5 shows this arrangement.

FIG. 5 shows coupling 114 comprising two members 114A and 114B. The member 114B is received on a part of the top hose 12 connected to the radiator 10 and member 114A is connected to the other part of the top hose 12, connected to the block. As in the coupling 14 shown in FIG. 3, adaptors 66 are used and sealing is by O-rings 70, only one of which is shown in FIG. 5. An air bleed 62 is present.

To use the apparatus of the present invention it is simply necessary to connect the coupling 14 or coupling 114 in the top radiator hose 12. Once the connections have been made the pump 22 may be operated by the air supply through conduit 46. The used coolant is removed from the cooling system while, at the same time, the cooling system is refilled with reconditioned or new coolant from the tank 28 or 30 not receiving the coolant to be reconditioned. The apparatus of the present invention generates sufficient power that it can overcome the thermostat pressure. A thermostat is typically located at the outlet of the block. The engine must reach a certain temperature before the thermostat opens to allow the coolant to pass to the radiator to be cooled. That is say the thermostat, which is present in all modern liquid cooled internal combustion engines, facilitates warm-up of the engine and also ensure that it runs at a constant temperature.

Once the coolant is removed it is led to one of the tanks 28 or 30 by directing valves 36 and 38 as required. The coolant may be chemically treated. This chemical treatment, carried out with well known chemicals, is facilitated by agitation through the sparges 52. Once reconditioned it can be pumped into the other storage tank through valve 36 where it is stored for use in the next cooling system. In addition to chemical treatment the various filters 40, 42 and 44 in the system remove solid particles.

Figure 2:
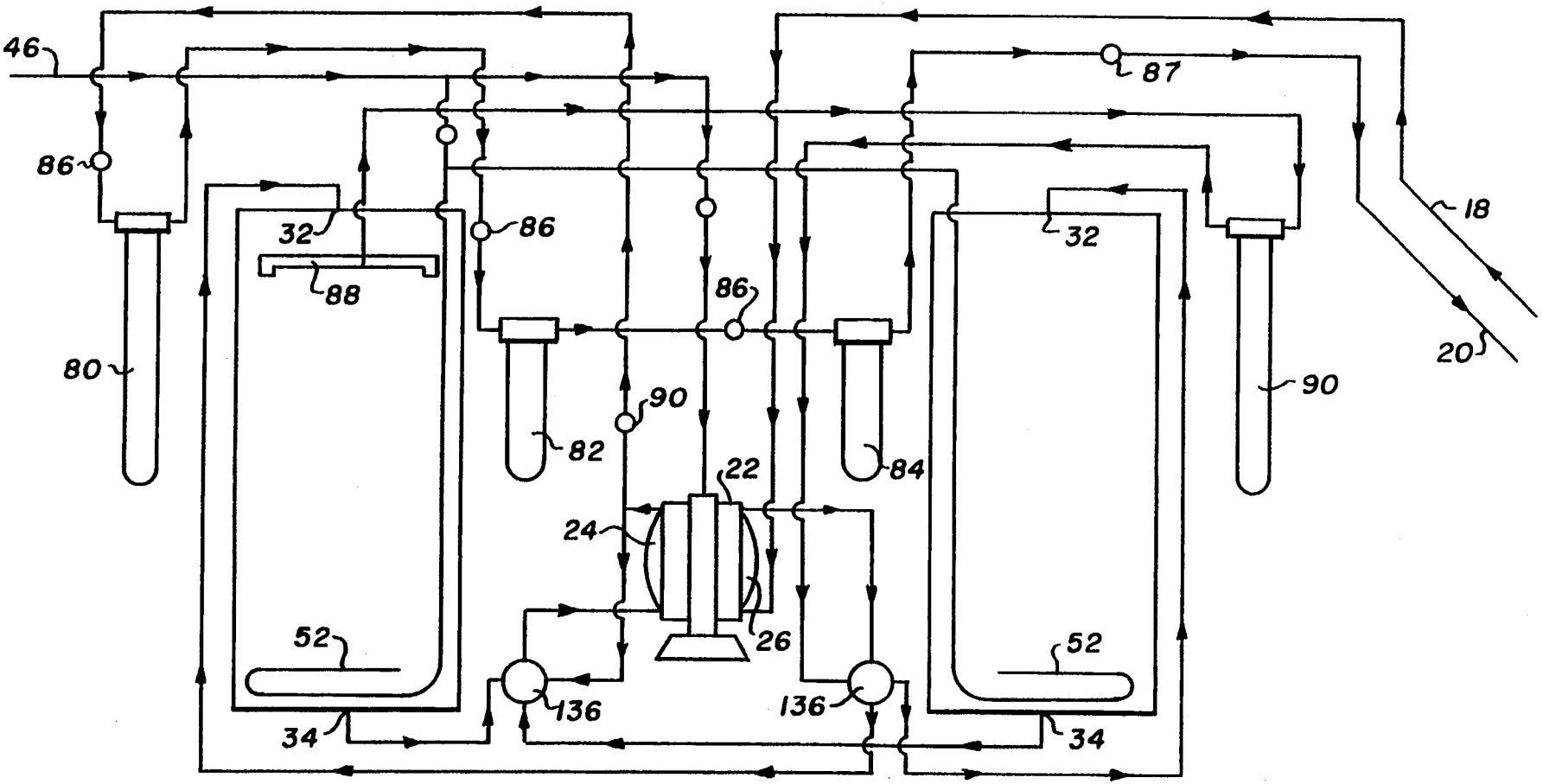
FIG. 2 is a schematic view illustrating a second apparatus according to the present invention.

FIG. 2 shows a slightly more complicated apparatus then that of FIG. 1. In general the same reference numerals are used for the same parts but the arrangement of the filters in FIG. 2 is different. There is a plurality of filters in the outlet pipe 20, after the pump 22. These filters receive reconditioned coolant in sequence. There is a first filter 80 that, generally speaking, is able to remove larger particles, for example those having a size greater than about 100 microns. A second filter 82 is able to remove smaller particles, for example having a size greater than about 30 microns, and a third filter 84 is able to remove relatively small particles, for example having a size greater than about 5 microns. From the third filter 84 the reconditioned coolant is returned to the engine. This system includes pressure gauges 86 before each filter and a flow indicator 87 in the outlet pipe 20.

FIG. 2 also shows the use of a skimmer 88 in the first tank 28. The skimmer 88 removes debris from the surface of the coolant. The effluent from the skimmer 88 passes to a fourth filter 90 and from there back to the inlet 32 of the tank 28 or 30.

The three-way valves 36 and 38 of FIG. 1 are replaced in the embodiment of FIG. 2 by four-way valves 136 and 138. The first four-way valve 136 is located between the tank outlets 34 and receives flow from the outlets 34 and from the pump 22. Valve 136 returns flow to the pump 22 and may receive outflow from side 24 of the pump 22. The outflow from side 24 of the pump 22 is directed either back to the four-way valve 136 or to first filter 80. Control of the flow is by a pressure regulator 90 in the conduit to the first filter 80. The second four-way valve 138 is between the inlets 32 of the tanks 28 and 30 and directs flow to the inlets, as desired. The four-way valve 138 receives coolant from the fourth filter 90 and from the inlet pipe 18, via said pump 22.

The apparatus of FIG. 2 is use precisely in the same manner as the apparatus of FIG. 1. The skimmer 88 and the additional filters mean that a more intensive removal of particles can be achieved but the chemical reconditioning, carried out in tanks 28 and 30, is the same.

The filters of the present invention may be those available under the trade mark Amatex. Especially the larger filters, that is to say those able to remove particles have a size greater than about 30 microns or about 100 microns. These filters are reusable. The smaller filters, that is those able to remove particles having a size greater than about 5 microns, may be spun polyfiber or white cellose fiber filters, again available under the trade mark Amatex.

The present invention thus provides a simple and efficient way of cleaning and reconditioning the cooling system and coolant of an internal combustion engine. As indicated above the apparatus is easy and quick to use. It is a closed loop hydraulic reverse flow system that is efficient and compact.

Although reconditioning of car systems has been described, the apparatus is appropriate in any similar circumstances. A car system has been exemplified but the system can be used to recondition the cooling system of large vehicles. It can be used in portable toilets and, anywhere, where a chemical reconditioning of a liquid is required including the removal of particles from that liquid.

Using the apparatus of the present invention a modern engine can be flushed and refilled within two to six minutes.

I claim:

1. Apparatus to change and recondition a coolant of a car having a radiator, an engine block and a top hose connecting the radiator and the engine block, said apparatus comprising:

a coupling adapted to be received in said top hose;

an inlet pipe and an outlet pipe adapted to be connected to said coupling;

a pump connected to said inlet pipe and said outlet pipe;

first and second tanks, each having an inlet and an outlet, to receive coolant from said pump, to supply coolant to said pump, to store reconditioned coolant and to receive coolant to be reconditioned;

valves to direct coolant flow;

whereby coolant can be withdrawn from the radiator, pumped to at least one of said first or second tanks reconditioned in that tank, passed to the an other of said first and second tanks and returned to the engine block.

2. Apparatus as claimed in claim 1 wherein:

the top hose has a breakable joint whereby the joint may be broken to receive the coupling then remade upon completion of the coolant reconditioning.

3. Apparatus as claimed in claim 1 wherein:

the coupling is a single coupling with a pair of inlets and a pair of outlets and an internal wall to separate inlet and outlet flows.

4. Apparatus as claimed in claim 1 wherein:

the coupling comprises a first member and a second member the first member being adapted to be received on a part of the top hose connected to the radiator, the second member being adapted to be received on a part of the top hose connected to the block.

5. Apparatus as claimed in claim 1 wherein:

in which the coupling includes an adapter to receive varying hose sizes.

6. Apparatus as claimed in claim 1 wherein:

the pump is a diaphragm pump.

7. Apparatus as claimed in claim 1 further comprising:

a filter in said outlet pipe before said pump.

8. Apparatus as claimed in claim 7 wherein:

the filter is a filter able to remove particles having a size greater than about 30 microns.

9. Apparatus as claimed in claim 1 further comprising:

a filter in said inlet pipe after said pump.

10. Apparatus as claimed in claim 9 wherein:

the filter is capable of removing particles having a size greater than about 5 microns.

11. Apparatus as claimed in claim 1 further comprising:

a three-way valve between said first and second tank inlets and said pump, whereby coolant received from said radiator can be directed to said at least one of said first and said second tanks as desired.

12. Apparatus as claimed in claim 1 further comprising:

a three-way valve between the first and second tank outlets and said pump, whereby at least one of said first and second tanks may be selected as a source of reconditioned coolant to return to said radiator.

13. Apparatus as claimed in claim 12 further comprising:

a filter between said three-way valve and said pump.

14. Apparatus as claimed in claim 13 wherein:

the filter is able to remove particles having a size greater than about 100 microns.

15. Apparatus as claimed in claim 13 further comprising:

a filter between said pump outlet and said radiator inlet.

16. Apparatus as claimed in claim 1 further comprising:

a plurality of filters in said outlet pipe, after said pump.

17. Apparatus as claimed in claim 16 wherein:

the plurality of filters comprises three filters, each of said three filters receiving reconditioned coolant in sequence.

18. Apparatus as claimed in claim 17 wherein:

the three filters include a first filter able to remove particles having a size greater than about 100 microns.

19. Apparatus as claimed in claim 18 wherein:

the three filters include a second filter able to remove particles having a size greater than about 30 microns.

20. Apparatus as claimed in claim 18 wherein:

the three filters include a third filter able to remove particles having a size greater than about 5 microns.

21. Apparatus as claimed in claim 1 further comprising:

a skimmer in at least one of said first and second tanks able to remove surface debris; and a filter in communication with said skimmer to remove said debris from the coolant, said filter having an outlet in communication with said first and second tank inlets.

22. Apparatus as claimed in claim 16 further comprising:

a four-way valve between said tank outlets to receive flow from said outlets and from said pump and to return flow to said pump, a direction of outflow from the pump being controlled by a pressure regulator in a conduit between said plurality of filters and said pump.

23. Apparatus as claimed in claim 21 further comprising:

a four-way valve between said inlets of said first and second tanks to direct flow to said inlets, as desired, said four-way valve receiving coolant from said filter and from said radiator via said pump.

* * * * *